US006336068B1

(12) United States Patent
Lawson et al.

(10) Patent No.: US 6,336,068 B1
(45) Date of Patent: Jan. 1, 2002

(54) CONTROL SYSTEM FOR WHEEL TRACTOR SCRAPERS

(75) Inventors: Matthew G. Lawson, Peoria; Tara L. Morr, Havana; Kermit A. Velder, Champaign, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/665,873

(22) Filed: Sep. 20, 2000

(51) Int. Cl.[7] ..... G06F 19/00

(52) U.S. Cl. ..... 701/50; 701/23; 701/27; 701/29

(58) Field of Search ..... 701/50, 23, 27, 701/29, 34; 172/2, 9; 37/348, 416, 414

(56) References Cited

U.S. PATENT DOCUMENTS

| | | | | | |
|---|---|---|---|---|---|
| 3,190,017 | A | | 6/1965 | Rockwell | 37/414 |
| 3,206,880 | A | | 9/1965 | Rockwell et al. | 37/414 |
| 3,346,972 | A | | 10/1967 | Johnson | 37/416 |
| 3,589,242 | A | | 6/1971 | Peterson et al. | 91/523 |
| 3,762,076 | A | | 10/1973 | Eftefield | 37/416 |
| 3,977,102 | A | * | 8/1976 | Ohms | 37/416 |
| 4,052,804 | A | * | 10/1977 | Stedman | 37/417 |
| 4,343,101 | A | * | 8/1982 | Klekamp et al. | 37/430 |
| 4,502,235 | A | | 3/1985 | Miyake et al. | 37/414 |
| 5,347,448 | A | | 9/1994 | Nam | 700/448 |
| 5,461,803 | A | * | 10/1995 | Rocke | 701/50 |
| 5,493,798 | A | * | 2/1996 | Rocke et al. | 37/443 |
| 5,528,843 | A | * | 6/1996 | Rocke | 37/348 |
| 5,682,312 | A | * | 10/1997 | Rocke | 701/50 |
| 6,092,316 | A | * | 7/2000 | Brinker | 37/416 |

* cited by examiner

*Primary Examiner*—William A. Cuchlinski, Jr.
*Assistant Examiner*—Marthe Marc-Coleman
(74) *Attorney, Agent, or Firm*—McGuireWoods LLP

(57) ABSTRACT

A control system to automate operations for wheel tractor scrapers. The control system simplifies the operation of the wheel tractor scraper by automating the many operations of the wheel tractor scraper which alleviates the operator from many of the operations of the wheel tractor scraper during the use thereof. The control system has a load control module, a haul control module associated with the load control module and an eject control module. The eject control module is associated with the load control module and the haul control module. The load control module, the haul control module and the eject control module control the loading, hauling and ejecting operations of the wheel tractor scraper.

20 Claims, 3 Drawing Sheets

CONTROL SYSTEM FOR WHEEL TRACTOR SCRAPERS

TECHNICAL FIELD

This invention relates generally to a control system and, more particularly, to a control system to automate operations for wheel tractor scrapers.

BACKGROUND ART

Earth moving machinery and more particularly wheel tractor scrapers are complex machines which include a great deal of skill to operate in an efficient manner. This is mainly due to the many complex features that are provided with these machines.

By way of example, wheel tractor scrapers include a load carrying bowl which is used to payload material scraped from a ground surface. The load carrying bowl may be moved into many different positions by the use of hydraulic lifts. In addition, the wheel tractor scraper may include several loading gears, aprons and implements (such as, for example, elevators and augers) as well as moveable ejectors and scrapers. All of these features must be controlled by the operator within the tractor cab of the wheel tractor scraper.

In order to control these features, the operator must not only be well acquainted with the controls of the tractor cab, but must also be trained to use such controls in the most efficient and safest manner. That is, the operator must be trained to use the controls so that the features of the wheel tractor scraper work in a precise sequence and within design parameters. This ensures that the wheel tractor scraper is working in its intended manner. This training can be quite complex and time consuming.

For example, in order to properly use the wheel tractor scraper, the operator must be able to control the raising and lowering of the load carrying bowl, and more particularly must be able to accurately adjust the load carrying bowl in order to ensure that the cutting edge of the load carrying bowl is properly scraping the ground surface. In addition, the operator must know when and how to properly adjust the implements so that the loaded material is properly distributed within the load carrying bowl. Simultaneously, the operator must select a proper loading gear and implement appropriate speeds, as well as select many other variables. To make the operation even more complex, the operator must also drive the tractor which includes steering, transmission shifting, braking and the like during the operation of these other features.

In U.S. Pat. No. 3,762,076 to Eftefield issued on Oct. 2, 1973, a hoeing control scraper system is provided. In Eftefield, an electro-hydraulic circuit provides semi-automatic control of movements of the hoeing apron loading device. Several fluid motors provide apron movement and are actuated and stopped by electric signals originating in the control circuit. In this manner, the apron can be efficiently controlled by the Eftefield system, but the Eftefield system still requires the operator to manually control the many features of the wheel tractor scraper.

The present invention is directed to overcoming one or more of the problems as set forth above.

DISCLOSURE OF THE INVENTION

In one aspect of the present invention a control system has a load control module, a haul control module associated with the load control module and an eject control module. The eject control module is associated with the load control module and the haul control module.

In another aspect of the invention a method for controlling operations of a wheel tractor scraper is provided. The method has the steps of providing initial preset values for operating the wheel tractor scraper. The method also has the steps of controlling a loading operation, a hauling operation and an ejecting operation using the initial preset values.

In still another aspect of the invention a wheel tractor scraper has a tractor mounted to a load carrying bowl. A hitch, cutting edge, moveable ejector, apron and material moving implement are also provided. A load control module, a haul control module and an eject control module control the wheel tractor scraper during a loading, hauling and ejecting operation.

BEST MODE FOR CARRYING OUT THE INVENTION

Figure 1:
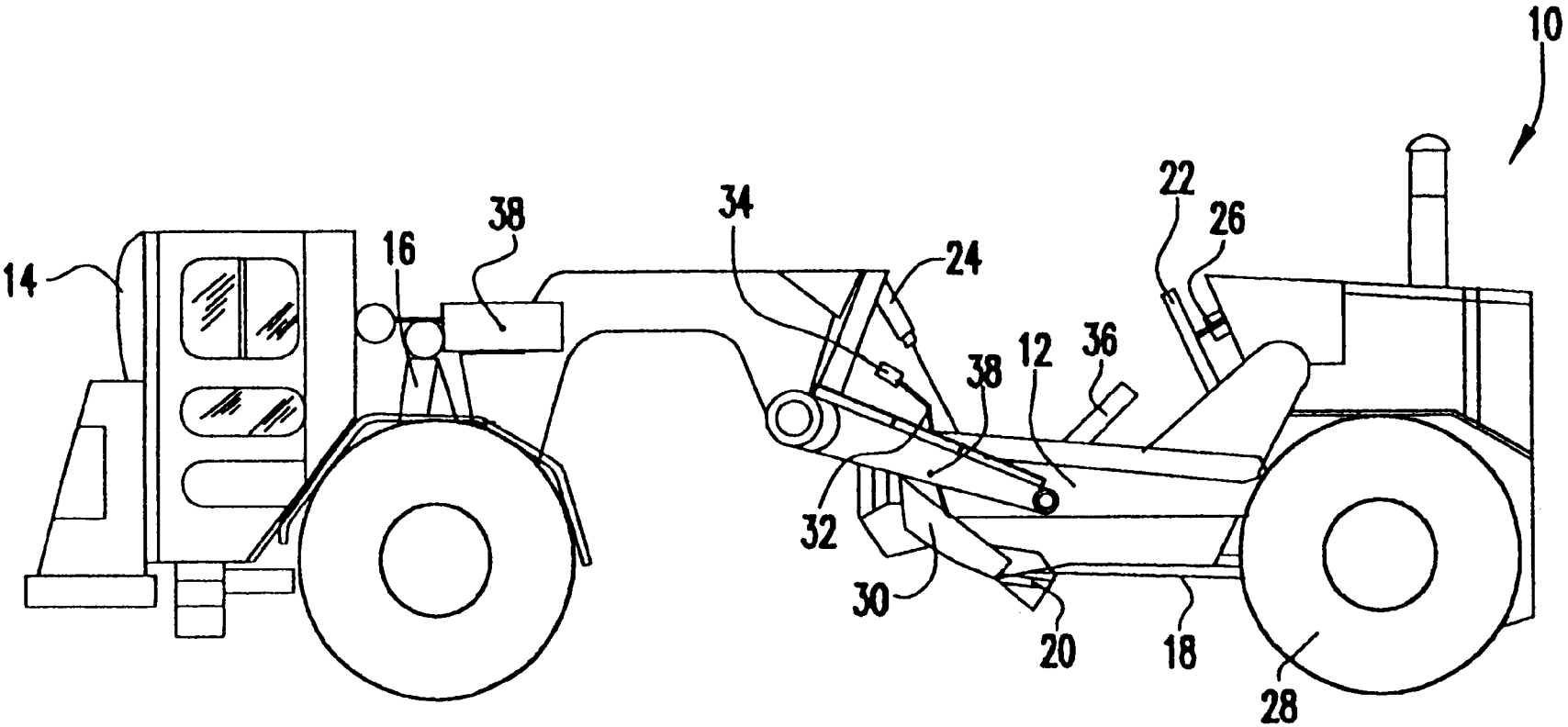
FIG. 1 shows a diagrammatic side plan view of a wheel tractor scraper adapted for use with the control system of the present invention.

FIG. 1 is a diagrammatic side plan view of a wheel tractor scraper which is used with the control system of the present invention. It should be recognized by those of skill in the art that other wheel tractor scrapers known in the art may also be used with the control system of the present invention, and that the wheel tractor scraper of FIG. 1 is not to be construed to limit in any manner the present invention.

The wheel tractor scraper of FIG. 1 is generally depicted as reference numeral 10 and includes a load carrying bowl 12. A tractor 14 is connected to the load carrying bowl 12 by a hydraulic or non-hydraulic hitch 16. The tractor 14 is any conventional tractor that is capable of hauling the wheel tractor scraper 10, and a discussion of such tractor will not be described herein.

The load carrying bowl 12 includes a floor 18 having a cutting edge 20. A rear wall of the load carrying bowl 12 is formed as a moveable ejector 22. A first set of hydraulic lifts 24 are mounted to a front of the load carrying bowl 12 and a second set of hydraulic lifts 26 are mounted between the moveable ejector 22 and the load carrying bowl 12. The second set of hydraulic lifts 26 may alternatively be mounted between the moveable ejector 22 and another stationary or fixed location such as, for example, rear wheels 28 of the load carrying bowl 12.

An apron 30 is mounted to the load carrying bowl 12 via an articulated support assembly 32. The articulated support assembly 32 is moveable between several positions including an opened and closed position by use of a third set of hydraulic lifts 34 mounted to the load carrying bowl 12. Material moving implements 36 such as an elevator or auger may also be positioned within the load carrying bowl 12 proximate to the cutting edge 20. Several sensors 38 are provided throughout the wheel tractor scraper 10 and are preferably mounted adjacent to (i) the load carrying bowl 12, (ii) the hitch 16, (iii) the cutting edge 20, (iv) the moveable ejector 22, (v) the apron 30 and (vi) the material moving implement 36.

Figure 2:
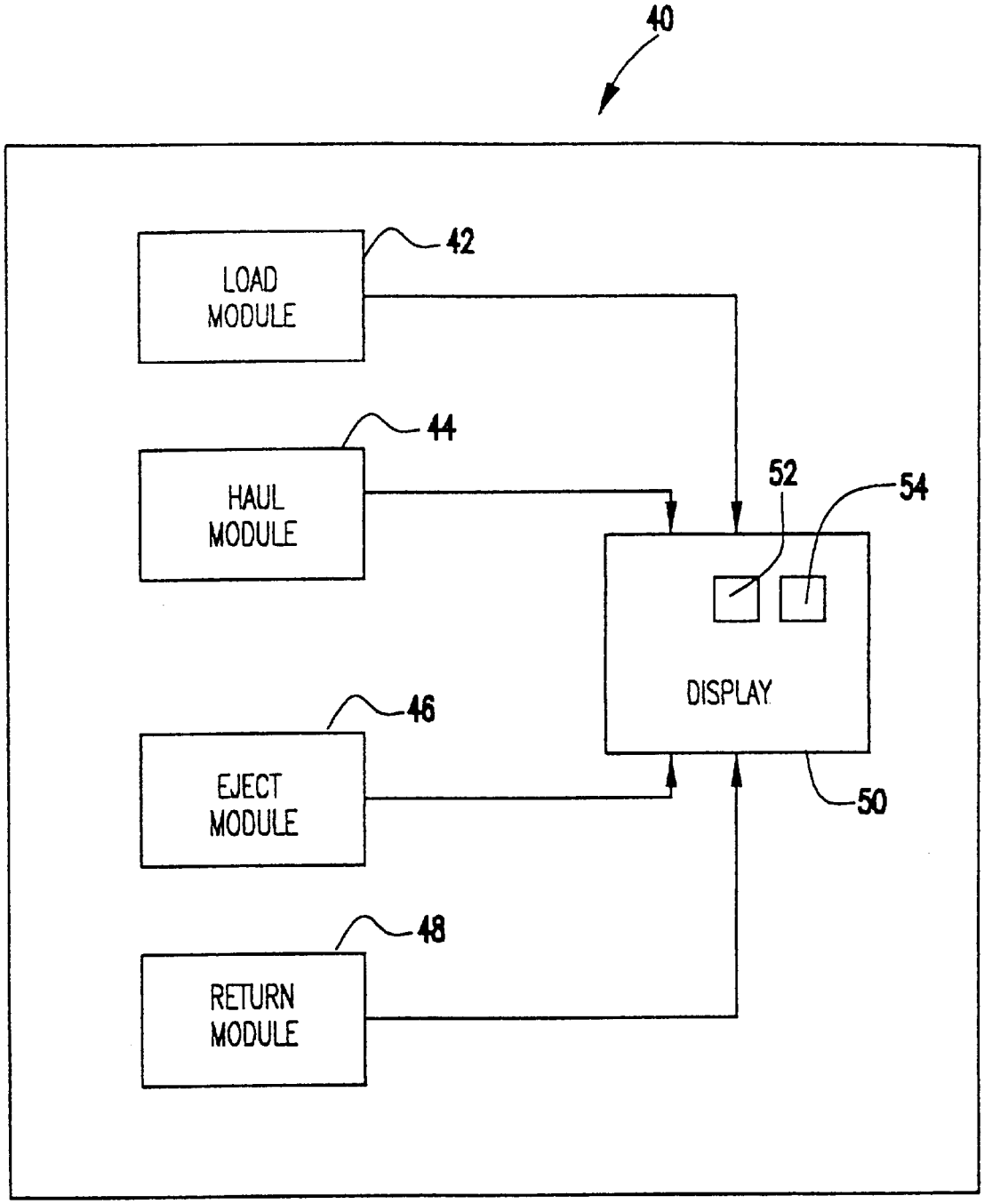
FIG. 2 shows a block diagram of the control system of the present invention.

Referring now to FIG. 2, a block diagram of the control system of the present invention is provided. The control system is preferably adaptable for use in all currently known wheel tractor scraper configurations and may be either presented in a modular design or a single discrete component.

Referring now to FIG. 2, the control system is generally depicted as a controller 40 which includes a load control module 42, a haul control module 44, an eject control module 46 and a return control module 48. The control system 40 also includes an operator display and control system 50 which is associated with the control modules 42, 44, 46 and 48. The control modules 42, 44, 46 and 48 control a loading operation, hauling operation, ejecting operation and return operation, respectively, of the wheel tractor scraper 10.

The operator display and control system 50 of FIG. 2 displays the above operations and may include a calibration system 52 and a self diagnostic function 54. The operator display and control system 50 also includes controls for presetting the positional values of the material moving implements as well as the other variables. By way of example, the controls of the operator display and control system 50 may include a manual mode control or alternatively include controls for:

The hydraulic hitch

The apron

The load carrying bowl

The moveable ejector and material moving implements

The load gears

Figure 3:
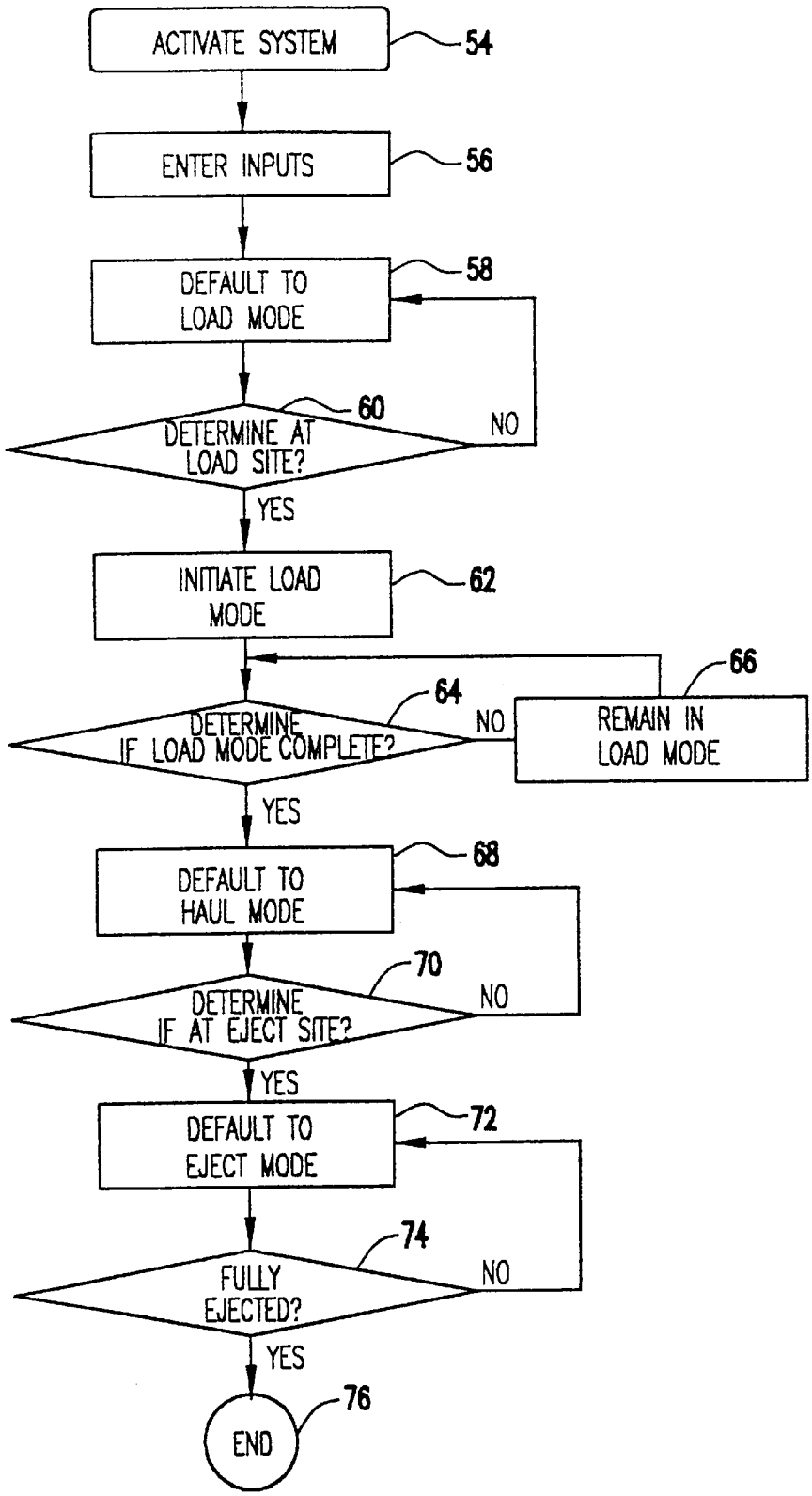
FIG. 3 shows a flow diagram implementing the control system of the present invention.

FIG. 3 shows a flow diagram implementing the control system of the present invention. In step 54, the control system of the present invention is activated. In step 56, the control system prompts the operator to enter new inputs into the control system of the present invention, or alternatively the control system of the present invention may default to previous inputs. The new inputs may be values relating to the load carrying bowl 12, the hydraulic hitch 16, the moveable ejector 22, the apron 30, the material moving implements 36 and the desired load gear.

In step 58, the control system of the present invention defaults to a loading operation mode. In step 60, a determination is made as to whether the wheel tractor scraper 10 is positioned at the loading site. If not, the control returns to step 58. If yes, the control system initiates and begins the loading operation mode in step 62.

In step 64, a determination is made as to whether the loading operation is completed. If not, the control system of the present invention remains in a loading operation mode in step 66, and then returns to step 64. If the loading operation is completed, the control system defaults to the haul mode in step 68.

In step 70, a determination is made as to whether the wheel tractor scraper 10 is in the eject area. If not, the control remains in the haul mode in step 68. If a positive determination is made in step 70, the control system will activate the hydraulic lifts 22 in order to eject the material from the load carrying bowl in step 72.

In step 74, a determination is made as to whether the ejecting operation is completed. If not, the control system returns to step 72; however, if the ejecting operation is completed then the control system ends in step 76. It is noted that each operational step including the steps of 62, 68 and 72 may be displayed on the display and control system 50.

Industrial Applicability

In use, the wheel tractor scraper 10 is controlled by the controller 40 in four modes of operation, a loading operation, a hauling operation, an ejecting operation and a return operation. The controller 40 automates these four modes of operation, via the control modules 42, 44, 46 and 48, by controlling the hydraulic hitch 16 and the hydraulic lifts 24, 26 and 34, as well as monitoring these systems via the sensors 38. The sensors 38 provide positional values for the many features of the wheel tractor scraper such as, for example, the load carrying bowl 12. This allows the control system of the present invention to automatically execute the many operational modes of the wheel tractor scraper 10. The operations may be initially activated by an operator by, for example, a toggle switch, push button or other activating mechanism.

Prior to the loading operation, the control system of the present invention prompts the operator to provide initial preset values in the display and control system 50. These preset values may include (i) whether the hydraulic hitch 16 is to be locked or unlocked during the ejecting and returning operations, (ii) the apron 30 position for the ejecting operations, (iii) the load carrying bowl 12 position for the loading, hauling and ejecting operations, (iv) the moveable ejector 22 speed, (v) the material moving implement speed and (vi) the desired load gear. Prior values may also be used with the control system of the present invention.

In the case of entering the values of (ii) and (iii), the operator may manually position the material moving implement and thereafter activate a set button on the display and control system 50. In the preferred embodiment, prior to setting the initial conditions, the operator will set the load carrying bowl 12 on the ground in order to calibrate the load carry bowl 12 to "0" depth (via the calibration button 52).

In the loading operation, the hydraulic hitch 16 is locked in a down or stationary position and the transmission of the wheel tractor scraper 10 is locked into a loading gear. The loading gear is preferably a first, second or third gear of an eight gear system. The moveable ejector 22 is checked to ensure that it is properly positioned in a back position, and the apron 30 is set within preset parameters (i.e., operator input open position) by activating the hydraulic lifts 34. The material moving implements 36 are also activated, at a preset operator parameter (as set in step 56 of FIG. 3).

In the loading operation, the hydraulic lifts 24 are also activated by the control system so that the load carrying bowl 12 can be lowered and the cutting edge 20 can begin to scrape the ground surface. As the cutting edge 20 scrapes the ground surface, material is loaded into the load carrying bowl 12. The material moving implements 36 may push the material within the load carry bowl 12.

Once the loading is completed, the control system is toggled into the hauling operation. In the hauling operation, the material moving implements 36 are deactivated and the apron is closed over the load carrying bowl 12 (via the articulated support assembly and hydraulic lifts 34). In this operational mode, the load carrying bowl 12 is also raised to a carry position. The hydraulic hitch 16 may be activated or unlocked (i.e., set to absorb road shock and stabilize machine travel) and the transmission of the wheel tractor scraper 10 is unlocked from the loading gear. The operator then transports the loaded material to an ejecting site.

Thereafter, the control system is toggled into the ejecting operation and the hydraulic hitch 16 is locked in the down or stationary position. The load carrying bowl 12 is raised by the hydraulic lifts 24. The apron 30 is also opened while the material moving implements 36 are activated. During this operational mode, the load within the wheel tractor scraper 10 is ejected from the load carrying bowl 12 at an operator selected rate (selected in step 56 of FIG. 3) for the moveable ejector 22.

The control system then automatically toggles into the return operation. At this operational stage, the control system automatically deactivates the material moving implements 36 and the load carrying bowl 12 is raised to a preset position (set in step 56). In this operational mode, the apron 30 is closed and the hydraulic hitch 16 may again be unlocked so as to absorb road shock and stabilize machine travel. The moveable ejector 22 is returned to an initial back position.

The operator display and control system 50 displays these operations. Also, during these operations, the self diagnostic function 54 is capable of continuously monitoring all operations of the wheel tractor scraper 10, and may display an error message when an operation is not working properly.

Other aspects and features of the present invention can be obtained from a study of the drawings, the disclosure, and the appended claims.

What is claimed is:

1. A control system for automating operations of a wheel tractor scraper, comprising:

a load control module controlling a loading operation of the wheel tractor scraper;

a haul control module controlling a hauling operation of the wheel tractor scraper;

an eject control module controlling an ejecting operation of the wheel tractor scraper after completion of the hauling operation; and a controller for sequentially executing in order the load control module, the haul control module and the eject control module, wherein the load control module controls components of the wheel tractor scraper including at least one of (i) a locking of a hydraulic hitch in a stationary position, (ii) a locking of at least one loading gear, and (iii) a moving of a moveable ejector and apron to a preset position.

2. The control system of claim 1, including a return module for returning the wheel tractor scraper to a preloading operation after the ejecting operation.

3. The control system of claim 1, including an operator display and control system for monitoring the loading, hauling and ejecting operations.

4. The control system of claim 3, including a calibration system for calibrating components of the wheel tractor scraper, the calibration system being associated with the operator display and control system.

5. The control system of claim 3, including a self diagnostic system for diagnosing components of the wheel tractor scraper, the diagnostic system being associated with the operator display and control system.

6. The control system of claim 3, wherein the operator display and control system includes controls adapted for the operator to preset positional values of the components of the wheel tractor scraper.

7. The control system of claim 1, wherein the load control module controls (iv) a speed of a material moving implement.

8. The control system of claim 7, wherein the haul control module controls (i) a raising of the load carrying bowl to a carry position, (ii) an activation of the hydraulic hitch, (iii) an unlocking of the at least one loading gear, (iv) deactivation of the material moving implement and (v) a closing of the apron.

9. The control system of claim 8, wherein the eject control module controls (i) a locking of the hydraulic hitch in a down position,(ii) a placement of the load carrying bowl and the apron into a preset position, (iii) the movement of the moveable ejector at a selected rate and (iv) the activation/speed of the material moving implement.

10. A control system for automating operations of a wheel tractor scraper, comprising:

a load control module controlling a loading operation of the wheel tractor scraper;

a haul control module controlling a hauling operation of the wheel tractor scraper;

an eject control module controlling an ejecting operation of the wheel tractor scraper after completion of the hauling operation;

a controller for sequentially executing in order the load control module, the haul control module and the eject control module;

an operator display and control system for monitoring the loading, hauling and ejecting operations, the operator display and control system including controls adapted for the operator to preset positional values of components of the wheel tractor scraper, the components including one of (i) a hydraulic hitch, (ii) an apron, (iii) a load carrying bowl, (iv) a moveable ejector, (vi) at least one loading gear and (v) a material moving implement; and a return module for controlling (i) a deactivation of the material moving implement, (ii) a raising of the load carrying bowl to a preset position, (iii) a closing of the apron, (iv) an unlocking of the hydraulic hitch and (v) a movement of the moveable ejector to an initial back position.

11. A method for automatically controlling operations of a wheel tractor scraper, comprising the steps of:

providing initial preset values for operating components of the wheel tractor scraper in a loading operation, hauling operation and ejecting operation, the components being at least one of a hydraulic hitch, a loading gear, a moveable ejector, an apron and a material moving implement;

controlling the loading operation using the initial preset values for the loading operation, the controlling loading operation including one of (i) setting a locking position of the hydraulic hitch in a stationary position, (ii) setting the loading gear, and (iii) positioning the moveable ejector and apron into a predetermined position; and controlling the hauling operation using the initial preset values for the hauling operation after completion of the loading operation; and controlling the ejecting operation using the initial preset values for the ejecting operation after completion of the hauling operation.

12. The method of claim 11, including:

determining whether the wheel tractor scraper is positioned at a loading site prior to the controlling the loading operation;

determining whether the loading operation is completed prior to the controlling the hauling operation; and determining whether the wheel tractor scraper is in an eject area prior to the controlling the ejecting operation.

13. The method of claim 11, including displaying the preset values for the loading operation, the hauling operation and the ejecting operation on a display.

14. The method of claim 12, wherein the controlling loading operation includes (i) setting a locking position of the hydraulic hitch in a stationary position, (ii) setting the loading gear, (iii) positioning the moveable ejector and apron into a predetermined position and (iv) setting a predetermined speed of the material moving implement.

15. The method of claim 11, wherein the controlling the hauling operation includes (i) raising the load carrying bowl to a carry position.

16. The method of claim 11, wherein the controlling loading operation includes (iii) setting a predetermined speed of a material moving implement.

17. A method for automatically controlling operations of a wheel tractor scraper, comprising the steps of:

providing initial preset values for operating the wheel tractor scraper in a loading operation, hauling operation and ejecting operation, the providing preset values being associated with a hydraulic hitch, an apron, a load carrying bowl, a moveable ejector, an implement and a load gear of the wheel tractor scraper;

controlling the loading operation using the initial preset values for the loading operation;

controlling the hauling operation using the initial preset values for the hauling operation after completion of the loading operation; and controlling the ejecting operation using the initial preset values for the ejecting operation after completion of the hauling operation, the controlling ejecting operation including at least one of (i) locking the hydraulic hitch in a down position, and(ii) placing the load carrying bowl and the apron into a preset position.

18. A method for automatically controlling operations of a wheel tractor scraper, comprising the steps of:

providing initial preset values for operating the wheel tractor scraper in a loading operation, hauling operation and ejecting operation, the providing preset values being associated with a hydraulic hitch, an apron, a load carrying bowl, a moveable ejector, an implement and a load gear of the wheel tractor scraper;

controlling the loading operation using the initial preset values for the loading operation;

controlling the hauling operation using the initial preset values for the hauling operation after completion of the loading operation;

controlling the ejecting operation using the initial preset values for the ejecting operation after completion of the hauling operation; and calibrating the load carry bowl to "0" depth prior to the step of providing initial preset values.

19. A wheel tractor scraper, comprising:

a tractor having a loading gear;

a load carrying bowl having a floor and a rear section;

a hitch connecting the tractor to the load carrying bowl;

a cutting edge extending from the floor;

a moveable ejector formed at the rear section of the load carrying bowl;

an apron mounted to the load carrying bowl and moveable between a first position and a second position;

a material moving implement mounted in the load carrying bowl;

a load control module for controlling the hitch, the loading gear, the moveable ejector, the apron and the material moving implement during a loading operation, the load control module controlling components of the wheel tractor scraper including at least one of (i) a locking of a hydraulic hitch in a stationary position, (ii) a locking of a loading gear, and (iii) a moving of a moveable ejector and an apron to a preset position;

a haul control module for controlling the load carrying bowl, the hydraulic hitch and the loading gear during a hauling operation; and an eject control module for controlling the hydraulic hitch, the load carrying bowl and the apron during an ejecting operation.

20. The wheel tractor scraper of claim 19, including a return module for controlling the material moving implement, the load carrying bowl, the apron, the hydraulic hitch and the moveable ejector during a returning operation after completion of the ejecting operation.

* * * * *